US008133106B2

(12) United States Patent
Englman

(10) Patent No.: US 8,133,106 B2
(45) Date of Patent: Mar. 13, 2012

(54) WAGERING GAME SYSTEM WITH NETWORKED GAMING DEVICES

(75) Inventor: Allon G Englman, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 841 days.

(21) Appl. No.: 11/919,731

(22) PCT Filed: Jul. 6, 2006

(86) PCT No.: PCT/US2006/026360

§ 371 (c)(1),
(2), (4) Date: Oct. 31, 2007

(87) PCT Pub. No.: WO2007/006002

PCT Pub. Date: Jan. 11, 2007

(65) Prior Publication Data

US 2009/0117969 A1 May 7, 2009

Related U.S. Application Data

(60) Provisional application No. 60/697,076, filed on Jul. 6, 2005.

(51) Int. Cl.
*A63F 9/24* (2006.01)

(52) U.S. Cl. ..... 463/16

(58) Field of Classification Search ..... 463/16, 463/25, 40–42; 700/92
See application file for complete search history.

(56) References Cited

U.S. PATENT DOCUMENTS

| | | | | |
|---|---|---|---|---|
| 5,083,271 | A * | 1/1992 | Thacher et al. | 700/92 |
| 5,655,961 | A | 8/1997 | Acres et al. | 463/27 |
| 5,761,649 | A | 6/1998 | Hill | 705/27 |
| 5,851,149 | A | 12/1998 | Xidos et al. | 463/42 |
| 6,183,366 | B1 | 2/2001 | Goldberg et al. | 463/42 |
| RE37,885 | E | 10/2002 | Acres et al. | 463/42 |
| 6,645,077 | B2 * | 11/2003 | Rowe | 463/42 |
| 6,805,629 | B1 | 10/2004 | Weiss | 463/16 |
| 6,860,810 | B2 * | 3/2005 | Cannon et al. | 463/20 |
| 6,908,390 | B2 | 6/2005 | Nguyen et al. | 463/42 |
| RE38,812 | E | 10/2005 | Acres et al. | 463/26 |
| 7,056,215 | B1 | 6/2006 | Olive | 463/27 |
| 7,108,603 | B2 | 9/2006 | Olive | 463/27 |
| 7,144,321 | B2 | 12/2006 | Mayeroff | 463/16 |

(Continued)

FOREIGN PATENT DOCUMENTS

| | | |
|---|---|---|
| WO | WO 01/15055 A1 | 8/2000 |

(Continued)

OTHER PUBLICATIONS

PCT International Search Report for International Application No. PCT/US2006/26360 dated Apr. 4, 2007.

*Primary Examiner* — Masud Ahmed
(74) *Attorney, Agent, or Firm* — Nixon Peabody LLP

(57) ABSTRACT

A method of operating a plurality of wagering game tournaments on a plurality of gaming machines includes receiving a wager from a player to play a wagering game on a gaming machine of the plurality of gaming machines. The method further includes providing an option, at the gaming machine, to enter the plurality of wagering game tournaments. The method also includes entering at least one of the plurality of wagering game tournaments and playing in any entered tournament when the tournament begins.

23 Claims, 16 Drawing Sheets

U.S. PATENT DOCUMENTS

| | | | | |
|---|---|---|---|---|
| 7,285,049 | B1 | 10/2007 | Luciano, Jr. et al. | 463/42 |
| 2002/0115488 | A1 | 8/2002 | Berry et al. | 463/42 |
| 2002/0187836 | A1* | 12/2002 | Meyer | 463/42 |
| 2004/0152516 | A1* | 8/2004 | Blatter et al. | 463/42 |
| 2004/0224771 | A1* | 11/2004 | Chen et al. | 463/42 |
| 2004/0225386 | A1* | 11/2004 | Thompson et al. | 700/92 |
| 2004/0259631 | A1* | 12/2004 | Katz et al. | 463/25 |
| 2006/0003835 | A1 | 1/2006 | Olive | 463/25 |
| 2006/0073887 | A1 | 4/2006 | Nguyen et al. | 463/27 |
| 2006/0073888 | A1 | 4/2006 | Nguyen et al. | 463/27 |
| 2006/0142079 | A1 | 6/2006 | Ikehara et al. | 463/27 |
| 2006/0217198 | A1* | 9/2006 | Johnson | 463/40 |
| 2007/0060314 | A1 | 3/2007 | Baerlocher et al. | 463/25 |
| 2007/0060321 | A1 | 3/2007 | Vasquez et al. | 463/27 |
| 2007/0191088 | A1 | 8/2007 | Breckner et al. | 463/20 |
| 2007/0218975 | A1 | 9/2007 | Iddings et al. | 463/25 |
| 2007/0259709 | A1 | 11/2007 | Kelly et al. | 463/20 |
| 2007/0265064 | A1* | 11/2007 | Kessman et al. | 463/25 |
| 2007/0293293 | A1 | 12/2007 | Baerlocher et al. | 463/16 |
| 2007/0298857 | A1 | 12/2007 | Schlottmann et al. | 463/16 |
| 2007/0298874 | A1 | 12/2007 | Baerlocher et al. | 463/27 |
| 2007/0298875 | A1 | 12/2007 | Baerlocher et al. | 463/27 |
| 2008/0020830 | A1 | 1/2008 | Ikehara et al. | 463/27 |
| 2008/0020831 | A1 | 1/2008 | Ikehara et al. | 463/27 |
| 2008/0020832 | A1 | 1/2008 | Iddings et al. | 463/27 |
| 2008/0020833 | A1 | 1/2008 | Baerlocher et al. | 463/27 |
| 2008/0020834 | A1 | 1/2008 | Breckner et al. | 463/27 |
| 2008/0020846 | A1 | 1/2008 | Vasquez et al. | 463/42 |
| 2008/0045344 | A1 | 2/2008 | Schlottmann et al. | 463/42 |
| 2008/0064502 | A1 | 3/2008 | Schlottmann et al. | 463/42 |
| 2008/0070680 | A1 | 3/2008 | Baerlocher et al. | 463/27 |
| 2008/0070692 | A1 | 3/2008 | Schlottmann et al. | 463/42 |
| 2008/0070693 | A1 | 3/2008 | Schlottmann et al. | 463/42 |
| 2008/0070694 | A1 | 3/2008 | Schlottmann et al. | 463/42 |
| 2008/0070695 | A1 | 3/2008 | Baerlocher et al. | 463/42 |
| 2008/0076514 | A1 | 3/2008 | Baerlocher et al. | 463/20 |
| 2008/0076515 | A1 | 3/2008 | Baerlocher et al. | 463/20 |
| 2008/0076517 | A1 | 3/2008 | Baerlocher et al. | 463/20 |
| 2008/0076552 | A1 | 3/2008 | Baerlocher et al. | 463/31 |
| 2008/0102916 | A1* | 5/2008 | Kovacs et al. | 463/16 |

FOREIGN PATENT DOCUMENTS

| | | | |
|---|---|---|---|
| WO | WO 2005/120672 | A1 | 12/2005 |
| WO | WO 2006/076185 | A2 | 7/2006 |
| WO | WO 2008/030904 | A2 | 3/2008 |

* cited by examiner

| | |
|---|---|
| 8:00 P.m. Jackpot Party Tournament $100 + 9 | 58 Players Registered |
| Touch Here For More Info | Press Here To Enter |

*Fig. 5a*

Jackpot Party Tournament

This Is A 15 Minute Tournament.
During This Tournament You Will Accumulate Points. At The Conclusion Of The Allotted Time The Following Places Will Be Paid In The Tournament.

Based On 50-60 Players

| | | |
|---|---|---|
| 1st | - | 35% Of The Prize Pool Currently $2030 |
| 2nd | - | 25% Of The Prize Pool Currently $1450 |
| 3rd | - | 20% Of The Prize Pool Currently $1160 |
| 4th | - | 8% Of The Prize Pool Currently $448 |
| 5th | - | 7% Of The Prize Pool Currently $406 |
| 6th | - | 5% Of The Prize Pool Currently $290 |

Current Prize Pool $5800

*Fig. 5b*

| Time | Game | Buy In | No Of Entrants |
|---|---|---|---|
| 6:00 p.m. | Jackpot Party | $100+9 | 58 |
| 6:15 p.m. | Video Poker - Deuces Wild | $30+9 | 20 |
| 6:30 p.m. | Jade Monkey | $50+9 | 12 |
| 6:45 p.m. | Monopoly Wild Dice | $5+1 | 1023 |
| 7:00 p.m. | Keno | $20+2 | 234 |

*Fig. 6a*

| Time | Game | Buy In | No Of Entrants |
|---|---|---|---|
| 11:00 p.m. | Jackpot Party Guaranteed $20,000 Prize Pool | $20+2 | 1023 |

*Fig. 6b*

Players Network
Sit And Go Tournament Schedule

| Game | Buy In | Entrants |
|---|---|---|
| Jackpot Party | $10+1 | 3/30 |
| Jackpot Party | $10+1 | 5/10 |
| Jackpot Party | $5+1 | 23/30 |
| Jackpot Party | $5+1 | 9/10 |
| Jade Monkey | $10+1 | 11/30 |
| Jade Monkey | $10+1 | 1/10 |
| Jade Monkey | $5+1 | 22/30 |
| Jade Monkey | $5+1 | 2/10 |

*Fig. 7*

| Date | Time | Game | Buy In | No. Of Entrants |
|---|---|---|---|---|
| 7/14/05 | 11:00pm | Nevada Slot Championship Jackpot Party | $200 + 20 | 2344 |
| 7/15/05 | 11:00pm | Nevada Slot Championship Jade Monkey | $200 + 20 | 5064 |
| 7/16/05 | 11:00pm | Nevada Slot Championship Championship Event Multi Game | $2000 + 200 | 1023 |

*Fig. 9a*

| Date | Time | Game | Buy In | No. Of Entrants |
|---|---|---|---|---|
| 7/14/05 | 11:00pm | Satellite to Nevada Slot Championship Jackpot Party | $20 + 2 | 1234 |

*Fig. 9b*

| Game | Buy In | No. Of Entrants |
|---|---|---|
| Step 1 Nevada Slot Championship | $2 + 0.20c | 2/21 |
| Step 2 Nevada Slot Championship | $40 + 2 | 4/11 |
| Step 3 Nevada Slot Championship | $400 + 40 | 2/5 |

*Fig. 9c*

WAGERING GAME SYSTEM WITH NETWORKED GAMING DEVICES

CROSS REFERENCE TO RELATED APPLICATIONS

This application is a U.S. national phase of International Application No. PCT/US2006/026360, filed Jul. 6, 2006, which claims the benefit of priority of U.S. Provisional Patent Application No. 60/697,076, filed Jul. 6, 2005, both of which are incorporated by reference in their entirety.

FIELD OF THE INVENTION

The present invention relates generally to gaming machines, and methods for playing wagering games, and more particularly, to a gaming network for playing a plurality of tournaments.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a method of operating a plurality of wagering game tournaments on a plurality of gaming machines includes receiving a wager from a player to play a wagering game on a gaming machine of the plurality of gaming machines. The method further includes providing an option, at the gaming machine, to enter the plurality of wagering game tournaments. The method also includes entering at least one of the plurality of wagering game tournaments and playing in any entered tournament when the tournament begins.

According to another aspect of the invention, a gaming machine for offering a plurality of wagering game tournaments on a gaming network includes a display and a controller. The display displays a base game of the wagering game in response to receiving a wager input from a player. The controller is coupled to the display and is programmed to initiate the base game on the gaming machine. The controller is further programmed to provide an option to enter a plurality of wagering game tournaments and to allow a player to play in any entered tournament when the entered tournament begins.

According to yet another aspect of the invention, a method of operating a plurality of gaming machines of a gaming network includes receiving a wager from a player to play a wagering game on a gaming machine of the plurality of gaming machines. The method further includes initiating the wagering game on the gaming machine and providing an option, at the gaming machine, to display leaderboard information. The method also includes selectively displaying information from the leaderboard information.

According to yet another aspect of the invention, a method of operating a gaming machine on a gaming network includes providing, at the gaming machine, a plurality of wagering games. The method further includes providing a plurality of tournaments involving the plurality of gaming wagering games.

According to yet another aspect of the invention, a computer readable storage medium or media is encoded with instructions for directing a gaming device to perform the above methods.

According to yet another aspect of the invention, a gaming machine includes a display and a controller. The display displays a base game of the wagering game in response to receiving a wager input from a player. The controller is coupled to the display and is programmed to initiate the base game on the gaming machine. The controller is further programmed to provide an option, at the gaming machine, to display on the display leaderboard information related to a tournament and to selectively display any of the leaderboard information related to the tournament.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 5A is a representation of a player entry screen, according to one embodiment of the present invention;

FIG. 5B is a representation of a player information screen, according to one embodiment of the present invention;

FIG. 6A is a representation of a player menu screen, according to one embodiment of the present invention;

FIG. 6B is a representation of a tournament display screen, according to one embodiment of the present invention;

FIG. 7 is a representation of a tournament display screen, according to another embodiment of the present invention;

FIGS. 9A-9C are representations of player menu screens, according to alternative embodiments of the present invention;

DETAILED DESCRIPTION

Figure 1:
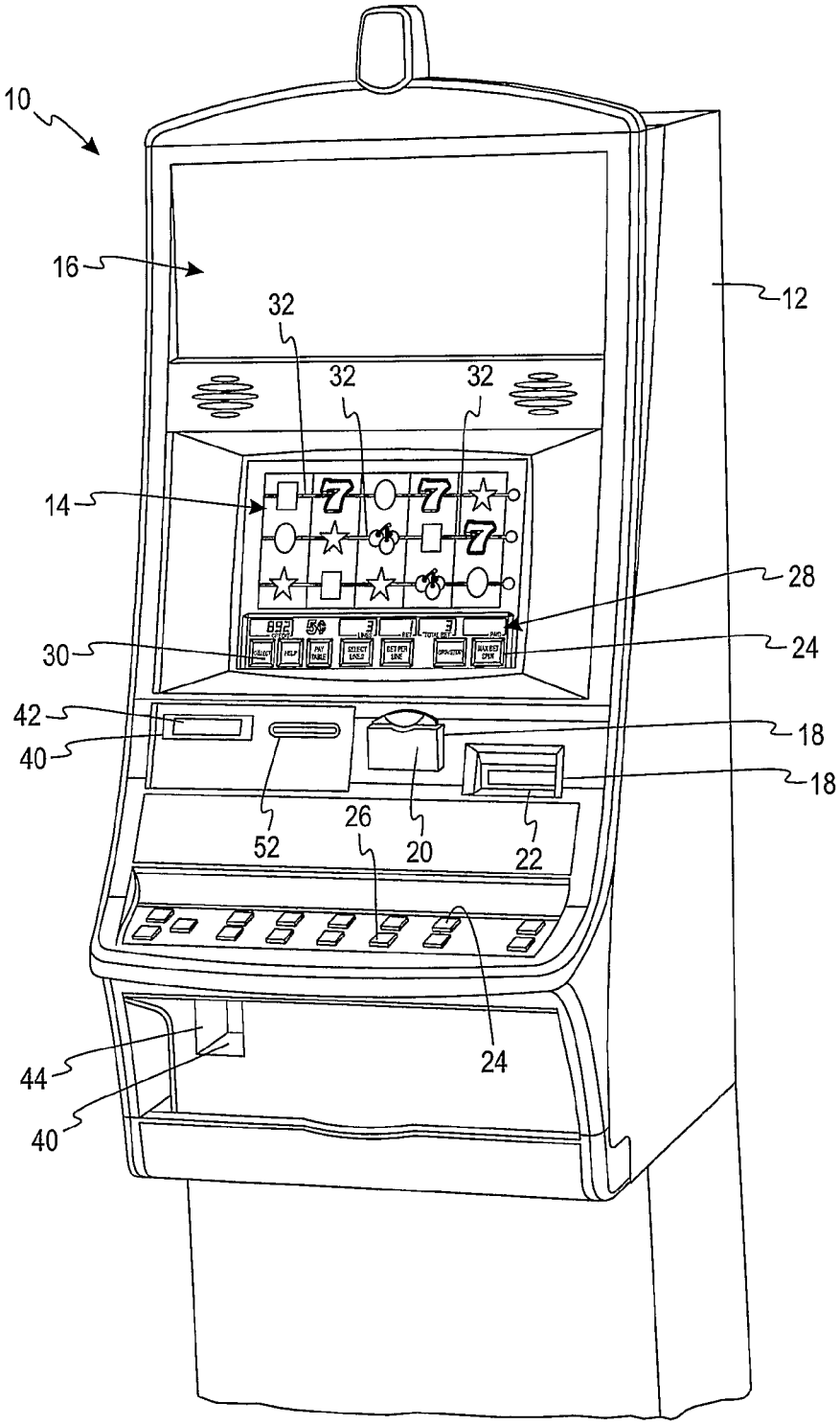
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual association to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
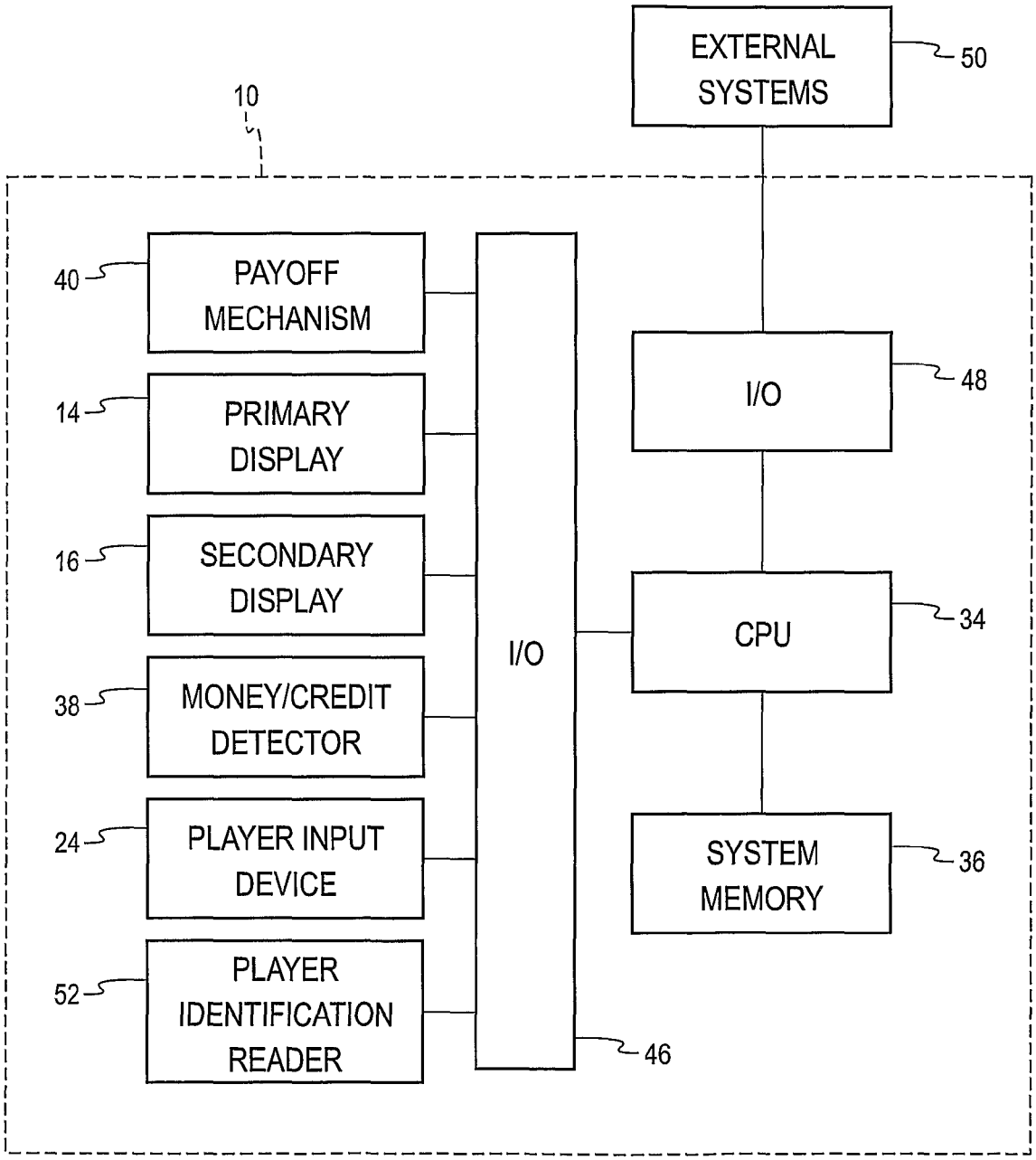
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Networking a series of gaming devices creates an environment that stimulates play and loyalty by developing many aspects of different gameplays. For example, a Winners Network includes a group of networked gaming devices that create a portal-type environment for a player. According to some embodiments of the present invention, the Winners Network includes one or more of a statewide network of gaming machines, a dual-screen gaming machine configuration (in which game art can be downloaded), and a player-identification ability.

Networked and downloadable gaming technologies provide many opportunities for creating new and different types of gameplay. Thus, the Winners Network opens new opportunities for operators of gaming machines and raises the current level of gaming, such as slot machine gaming, to a higher level. A goal of the Winners Network is to deliver a valuable player experience in the System-Based Gaming ("SBG") world by introducing features that are not generally found in any other type of non-linked and downloadable gaming machines. In addition, the Winners Network can introduce new and diverse features because historical constraints, e.g., hardware and math/gameplay adaptability, are no longer applicable.

The Winners Network includes three areas: tournaments (e.g., a slot tournament), cash games, and leaderboards. Tournaments have always been a popular part of slot culture; however, most players never participate in slot tournaments because casinos usually reserve such tournaments for the casinos' best customers. While tournaments have taken the poker and blackjack worlds by storm, tournaments have been restrained in the slot world because of hardware and networking constraints.

A slot tournament, which is an untapped market of the slot machine world, provides many benefits for the player and/or for the gaming establishment. One benefit for the player is a perception of value, wherein the player's losses are restricted only to the player's buy-in cost. Another benefit for the player is the ability to win a large sum of money for a low stake. Thus, by making prize pools "top heavy," large prizes can be generated for a low buy-in cost.

Similarly, the gaming establishment can benefit from a slot tournament. For example, a large pool of competitors can be provided because the slot tournament allows non-skilled base competition. Another benefit is a value proposition based on a new possible stream of revenue, wherein the gaming establishment can participate in tournament revenue. Other benefits include gaming operator/establishment familiarity, wherein most major casino chains host major slot tournaments on a free basis as a promotion, and perfect use of SBG, wherein the casino establishment has the ability to configure a machine for a tournament based on player selection.

In addition to tournaments, tremendous opportunities are present in the cash play, or normal, sphere. Gameplay flexibility is an important gameplay aspect for delivering player satisfaction in an SBG environment. The Winners Network provides a player the maximum flexibility of features and functionality in the cash game area.

Other opportunities for increasing a player's gameplay satisfaction are present in leaderboards. For example, leaderboards can be used to generate player loyalty by providing overt player recognition, which is a characteristic associated with successful slot machines. Maximizing and promoting player recognition is another solution provided by the Winners Network.

Figure 3:
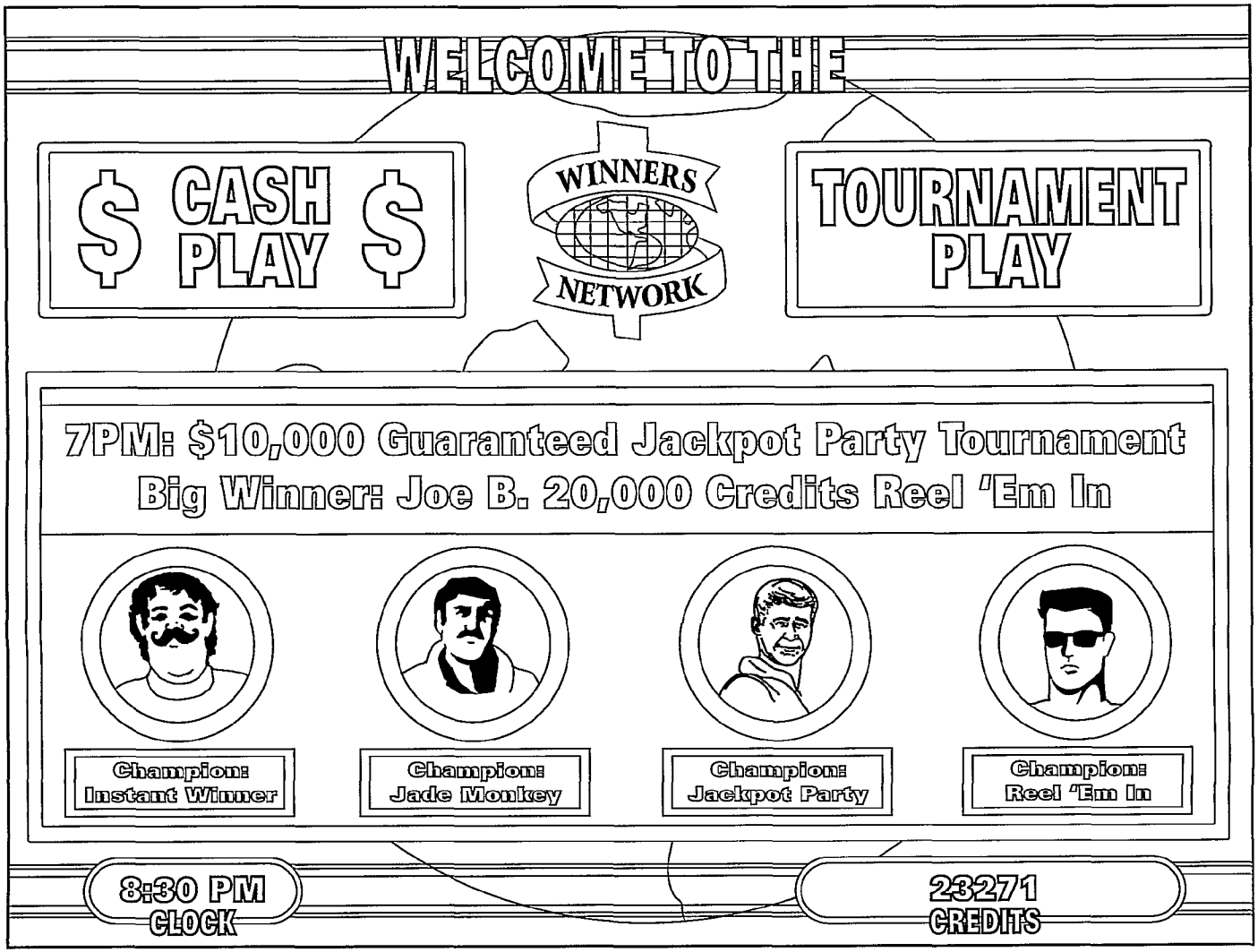
FIG. 3 is a representation of a player menu, according to one embodiment of the present invention.

Referring to FIG. 3, a player's menu is included in the primary display 14 for gameplay in the Winners Network. The player has the option to select two modes of play, "Cash Play" or "Tournament Play." In addition, a large portion of the primary display 14 is used to promote upcoming tournaments, as well as current leaders of specific game types. For example, the primary display 14 includes an announcement that a "$10,000 Guaranteed Jackpot Party Tournament" is scheduled for 7 p.m. The primary display 14 also includes the name of "Joe B.," who is the "Big Winner" of 20,000 credits in the "Reel 'Em In" game. Champion photographs for various popular reel slot games, e.g., "Instant Winner," "Jade Monkey," "Jackpot Party," and "Reel 'Em In," are also included in the primary display 14. In an alternative embodiment, at least a portion of the player's menu and any other identification information is displayed in the secondary display 16.

Figure 4:
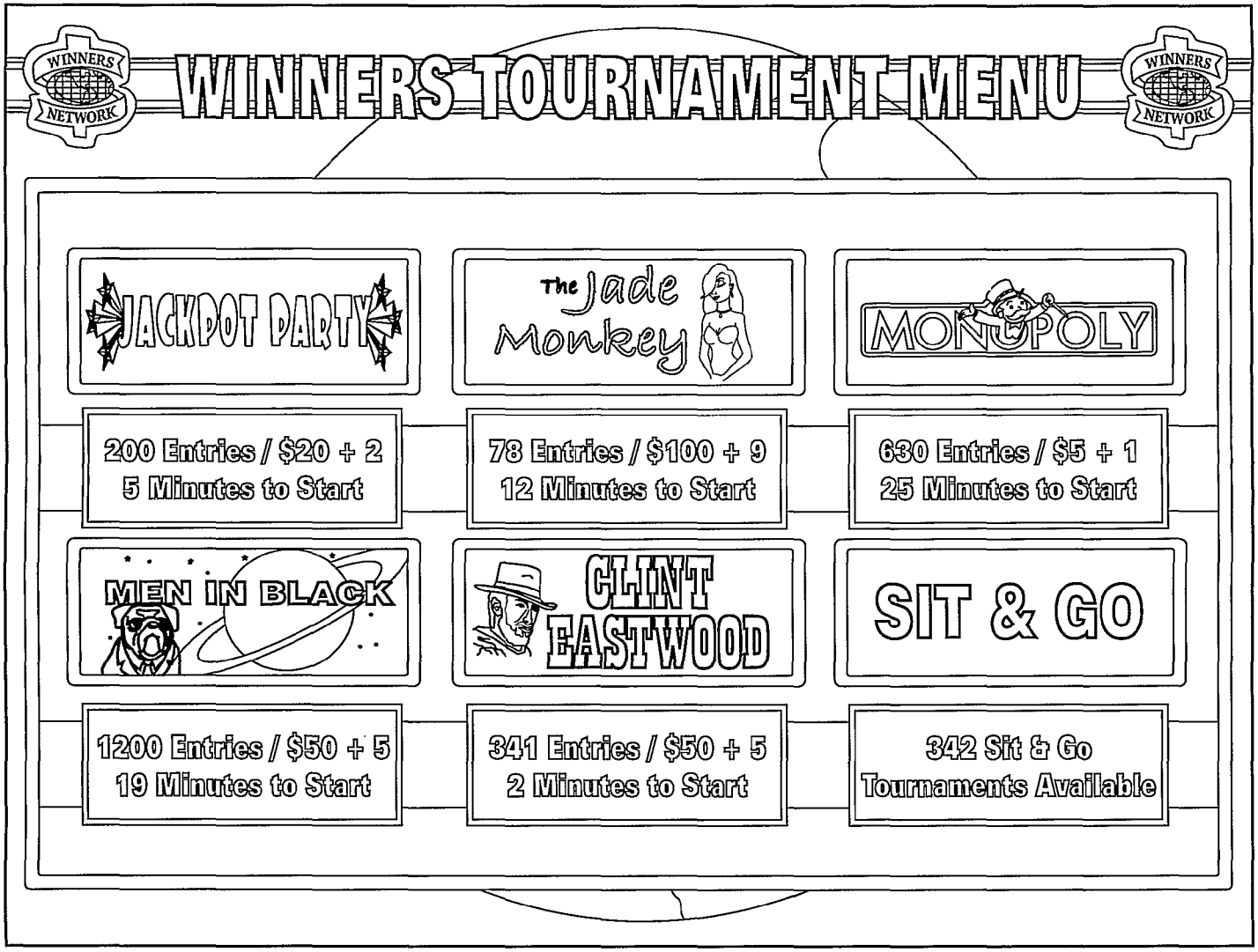
FIG. 4 is a representation of a tournament menu, according to one embodiment of the present invention.

Referring to FIG. 4, a tournament menu is displayed, which includes in general two different types of tournaments. A first type of tournament is a time-limited points-driven tournament. In this type of tournament the player is allotted a set period of time to earn as many points as possibly by playing various games, such as slot games, poker games, and keno games. The player attempts to earn as many points as possible within the set period of time. When the set period of time expires, the player is awarded prize money based on his or her ranking relative to all the other tournament players. This type of tournament is similar to current tournaments being held in casino establishments.

A second type of tournament is a credit-driven buy-in tournament. This type of tournament includes two fee components. A first fee component is the player buy-in entry fee, for an agreed number of credits. A second fee component is a house fee. After the tournament ends, e.g., after a set period of time has expired, the player receives the number of credits remaining from the game and any prize money, which are received based on the player's ranking in the tournament.

The tournament menu includes, for example, a "Jackpot Party" tournament, which is scheduled to start in "5 minutes." The "Jackpot Party" tournament is a credit-driven buy-in tournament. Currently, there are 200 entries in the tournament, i.e., 200 players have entered. The buy-in entry fee for the "Jackpot Party" is $20 and the house fee is $2.

Referring to FIG. 5A, a player entry screen shows that the "Jackpot Party" tournament begins at 8 p.m. and that the entry fee is $100. The entry fee is used to fund the prize money for the tournament. A house fee of $9 is charged by the casino establishment. Currently, 58 players have registered to enter the tournament. As additional players register, the number is updated. To register, the player touches the "Press here to enter" button. If the player touches the "Touch here for more info" button, additional information is presented as described below in reference to FIG. 5B.

Referring to FIG. 5B, additional information is presented for describing the "Jackpot Party" tournament. The tournament time period is set to 15 minutes, during which the player accumulates points. When the 15 minutes have expired, the top 6 ranked players are awarded prize money. Assuming that 50-60 players have entered the tournament, the prize pool is about $5,800. The $1^{st}$ prize is 35% of the prize pool, i.e., about $2,030. The $2^{nd}$ prize is 25% of the prize pool, i.e., about $1,450. The $3^{rd}$ prize is 20% of the prize pool, i.e., about $1,160. The $4^{th}$ prize is 8% of the prize pool, i.e., about $448. The $5^{th}$ prize is 7% of the prize pool, i.e., about $406. The $6^{th}$ prize is 5% of the prize pool, i.e., about $290.

Alternatively, a house fee is included in the buy-in entry fee. Thus, instead of charging a secondary fee, a set portion of the prize pool can be withheld. For example, 5% of the prize pool can be withheld as the house fee.

When the player enters a tournament, the player can play in other tournaments or cash games until the entered tournament starts. When the entered tournament starts, it plays much like a regular slot tournament, except that there is no tournament director or staff. The remaining time and the scores are indicated, for example, on the top portion of the secondary display 16. Alternatively, the remaining time and the scores are indicated in any convenient portion of the primary display 14 and the secondary display 16. At the conclusion of the tournament all the prizes are placed directly into a credit meter of the winning players.

Referring to FIG. 6A, one type of a slot tournament that can be played over a network is a planned tournament. A planned tournament can be planned for a certain time of the day. For example, each planned tournament is set to start every 15 minutes at different buy-in levels. Further, each planned tournament incorporates different games and/or features. On the menu screen, the player is presented the necessary information. For example, the menu screen indicates that at 6 p.m. a "Jackpot Party" tournament is scheduled to start. The entry fee is $100 for the prize pool, and an additional house charge of $9 is applied. Accordingly, a player must pay a total of $109 to register for the "Jackpot Party" tournament. Currently, 58 players have registered for the tournament.

Referring to FIG. 6B, another type of a slot tournament is a guaranteed tournament. This type of tournament awards a guaranteed prize pool. A risk associated with this type of tournament is that the number of participants can fall below a required level of profit. However, careful planning and risk management can allow a gaming establishment to use this type of tournament to increase gaming traffic during non-peak periods. For example, if there is a noticeable drop in tournament play at around 10:30 p.m., a well-placed guaranteed tournament at around that time could increase gaming traffic The gaming establishment can place a "Jackpot Party" tournament with a "Guaranteed $20,000 Prize Pool" at 11 p.m. to increase the number of participants.

Figure 8:
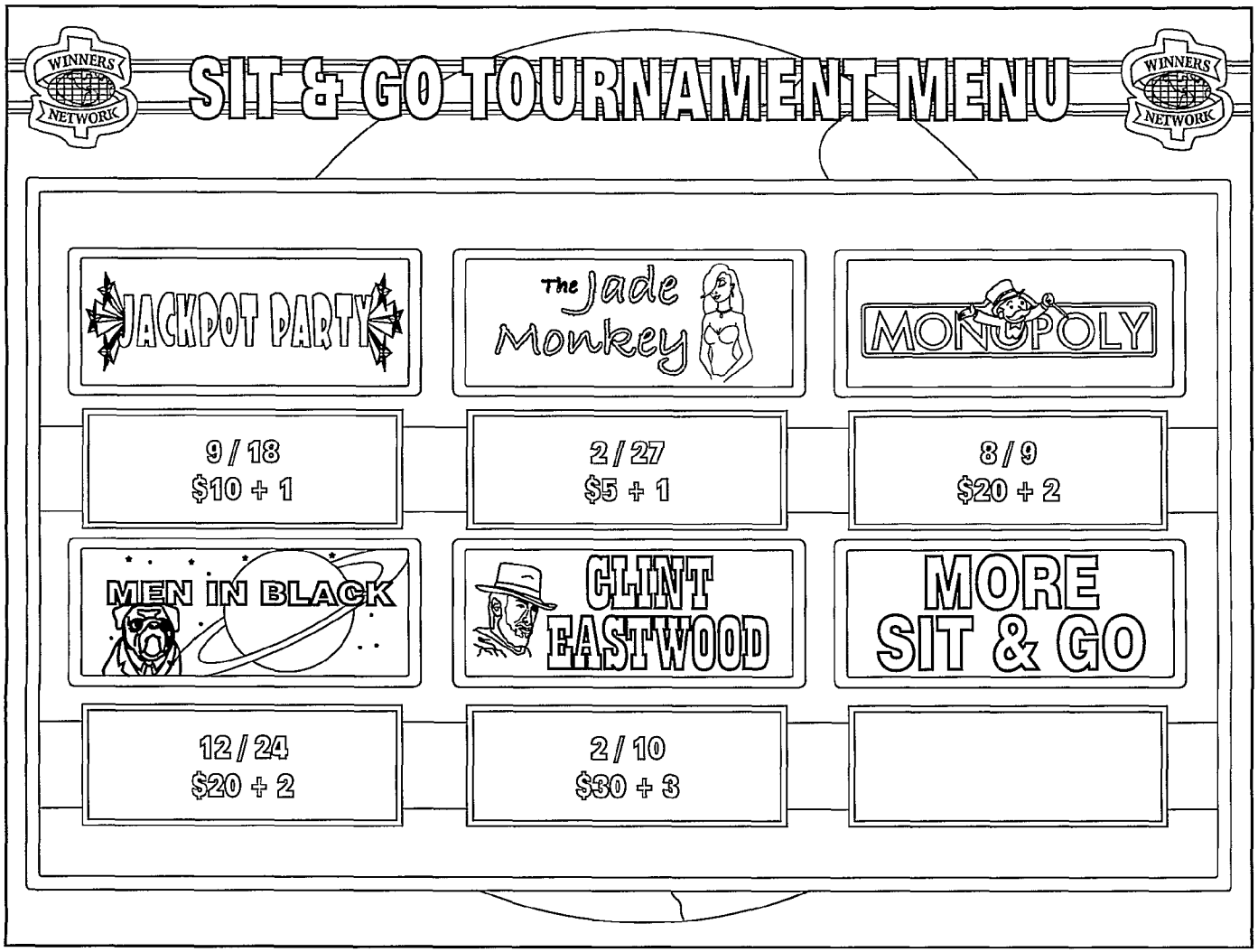
FIG. 8 is a representation of a tournament menu, according to an alternative embodiment of the present invention.

Referring to FIGS. 7 and 8, another type of a tournament is a "Sit and Go" tournament, which allows players to set up impromptu tournaments at their choosing. A "Sit and Go" menu includes a series of different buy-in levels, games, and participants. Accordingly, players can customize their own tournaments by selecting various features. Further, this type of tournament has a set number of entrants, or participants.

When the set number of entries is reached, the tournament begins. For example, a first "Jackpot Party" tournament (the first entry listed in FIG. 7) includes a set number of 30 participants. Currently, only 3 participants have entered the tournament. The entry fee is $10 and the house fee is $1. When 27 additional participants have registered to enter the tournament, the tournament will begin.

In another example, a "Clint Eastwood" tournament (shown in FIG. 8) requires 10 participants. The entry fee is $30 and the house fee is $3. Currently, only 2 players have registered for the tournament.

If a player desires additional tournaments, he or she can press the "More Sit & Gos" button. When the required number of participants is reached, the "Sit and Go" tournament will interrupt the players' other games and take the players to the "Sit and Go" tournament.

Referring to FIG. 9A, a player menu indicates information regarding another type of tournaments, Champion tournaments, which occur at set time intervals. Champion tournaments have higher buy-in entry fees and carry more prestige than most tournaments. This type of tournaments can be held over the course of a week. For example, a Nevada Slot Championship can have a series of tournaments/events over a week. One tournament of the Nevada Slot Championship is a "Jackpot Party" tournament, which is scheduled for Jul. 14, 2005 at 11 p.m. Currently, there are 2344 participants, wherein the entry fee is $200 and the house fee is $20. The Nevada Slot Championship further includes a "Jade Monkey" tournament, which is scheduled a day later than the "Jackpot Party" tournament, and a "Championship Event Multi Game," which is scheduled two days later than the "Jackpot Party" tournament.

Referring to FIG. 9B, a player menu indicates information regarding another type of tournaments, Satellite tournaments, which allow the player to qualify for a larger tournament by finishing in a set ranking in a satellite tournament. One reason for running satellite tournaments is to ensure large prize pools and high number of entries in a Championship tournament. For example, the Satellite tournament to the Nevada Slot Championship (shown in FIG. 9A) currently has 1,234 participants. In this example, the Satellite tournament requires a $20 entry fee (plus a $2 house fee). Because the Nevada Slot Championship requires a $200 entry fee (plus a $20 house fee), one entry to the Nevada Slot Championship will be awarded for every 10 entries in the Satellite tournament.

Referring to FIG. 9C, a player menu indicates information regarding another type of tournaments, Stepped tournaments, which are similar to Satellite tournaments. However, in contrast to Satellite tournaments, Stepped tournaments offer a stepped progression starting from an extremely low buy-in and culminating, if the player is lucky, in a place at a much larger tournament. For example, to gain entry in a $2,000 Championship Event, e.g., Nevada Slot Championship, a stepped progression may require 3 steps. In Step 1, the entry fee is $2 and the house fee is 20 cents. Currently, 2 of the required 21 participants have entered. If the player wins the Step 1 round, the player advances to a Step 2 round. In Step 2, the entry fee is $40 and the house fee is $2. Currently, 4 of the required 11 participants have entered. If the player wins the Step 2 round, the player advances to a Step 3 round. In Step 3, the entry fee is $400 and the house fee is $40. Currently, 2 of the required 5 participants have entered. If the player wins the Step 3 round, then the player advances to the Nevada Slot Championship.

Other tournaments include All Day tournaments, Multi Game tournaments, Free Roll tournaments, Open Events for Particular Casino Customers tournaments, Qualified tournaments, Shoot Out tournaments, Video Poker tournaments, and Keno tournaments. In an All Day tournament the identity of the player is known. The tournament is similar to a regular slot tournament except that the player plays his or her segment at any time during the day independent of other players of the tournament. Thus, the player has the flexibility to play the slot tournament at his or her convenience during the day. At the conclusion of the day, the prizes are distributed to the player's account.

In a Multi Game tournament, multiple games are used as long as the percentage and volatility of the games is generally similar. For example, a Multi Game tournament can be a "Monopoly™ Free For All" tournament, which allows a player to play any of the available "Monopoly™" reel slot games on the network.

To drive occupancy for a particular weekend, or for a particular time of day, a casino may use a Free Roll tournament. This type of tournament is a free tournament in which the casino provides the prize pool. The casino may offer a Free Roll tournament as a promotion using player-tracking cards.

While the tournaments described above are statewide tournaments, other tournaments can be local area tournaments for local players. For example, individual customer accounts such as Harrah's gaming establishment can have a local area tournament in which participating players are eligible for entry only if they are located on Harrah's property. Thus, only players that are physically present on Harrah's property would be eligible for playing in "Harrah's World Series of Slots" tournament.

Occasionally, a casino may run a free roll tournament where the casino provides the prize pool in a Qualified, or Champions, tournament. To qualify, the player is required to win one or more tournaments. For example, if a casino operator such as Harrah's conducts a "World Series of Slots" tournament using the Winners Network, Harrah's can conduct a tournament of Champions at the conclusion of the "World Series of Slots" tournament in which all the winners of the "World Series of Slots" events are eligible for participation.

A Shoot-Out tournament allows a player to play against a smaller contingent of players in a large tournament. For example, in a 1,000 player shootout, the player initially plays 10 random opponents in round one. If the player wins, he or she advances to round two. In the second round, only the winners from the first round are eligible. Thus, in the second round only 100 people are eligible for participation. The 100 people are divided into groups of 10 in the second round. If the player wins, he or she advances to the final round. In the final round only 10 people are eligible for participation, i.e., the winners of the second round. This type of tournament has a positive psychological impact on the player because the player has to beat 1,000 players in increments of 10, rather than having to beat all the players at once. Accordingly, the player may perceive this type of tournament to be easier than a normal tournament.

While the above described tournaments are generally related to slot tournaments, other type of tournaments can be played. A Video Poker tournament is similar to a slot tournament except that a large component of player skill is involved in the outcome. Video Poker tournaments include Time Based tournaments and Hand Based tournaments. A Time Based tournament rewards the player for skill, accuracy, and speed. The player is given a set amount of time during which the player plays as many hands as possible to maximize winning points. At the conclusion of the allotted time, the prize pool is apportioned based on the number of points accumulated. A Hand Based tournament allows a set number of hands to be played, wherein the player maximizes the returns for each of the hands. Thus, in this type of tournament the player's skill is rewarded, wherein time is generally not a factor.

Keno tournaments are another type of game tournaments. In a Keno tournament, the player is allowed one minute to select his or her numbers. At the conclusion of the minute, the player automatically receives a computer-generated selection. During the tournament, the player accumulates as many points as possible within the set time frame. The winning numbers can be generated by an individual gaming terminal or from the gaming server.

A Player Option menu can be used to store player options in tournaments where a player's information is known. If player information is not stored in the Player Option menu, the player options are stored in a tournament entry screen.

A player option is an Autoplay option that allows the player to minimize the number of times he or she is required to press a button when playing in a tournament. Thus, Autoplay allows the player to play at the fastest maximum speed. In addition, Autoplay allows the player to play in multiple tournaments at the same time. One type of Autoplay is Full Autoplay, in which all functions of the gaming device are handled automatically (including bonus rounds and any form of interaction). Another type of Autoplay is Base Game Autoplay, in which all interactive aspects of the gameplay require the player's participation.

Another player option is related to the identity of the player. The player can choose to remain anonymous to all other parties. If the player chooses to remain anonymous, the player is assigned an identifier, e.g., a random number, that is displayed in leaderboards and on tournament information screens.

Player information can be accessed through an information button. The information includes the number of players online, which indicates to the player how many other players are currently logged on the network, and how many tournaments are in play. For example, the information can indicate that 2,300 players are currently playing 4,450 tournaments.

Another player option includes a Find A Player option. This option allows the player to input another player's name to find the tournaments in which the other player has entered.

Figure 10:
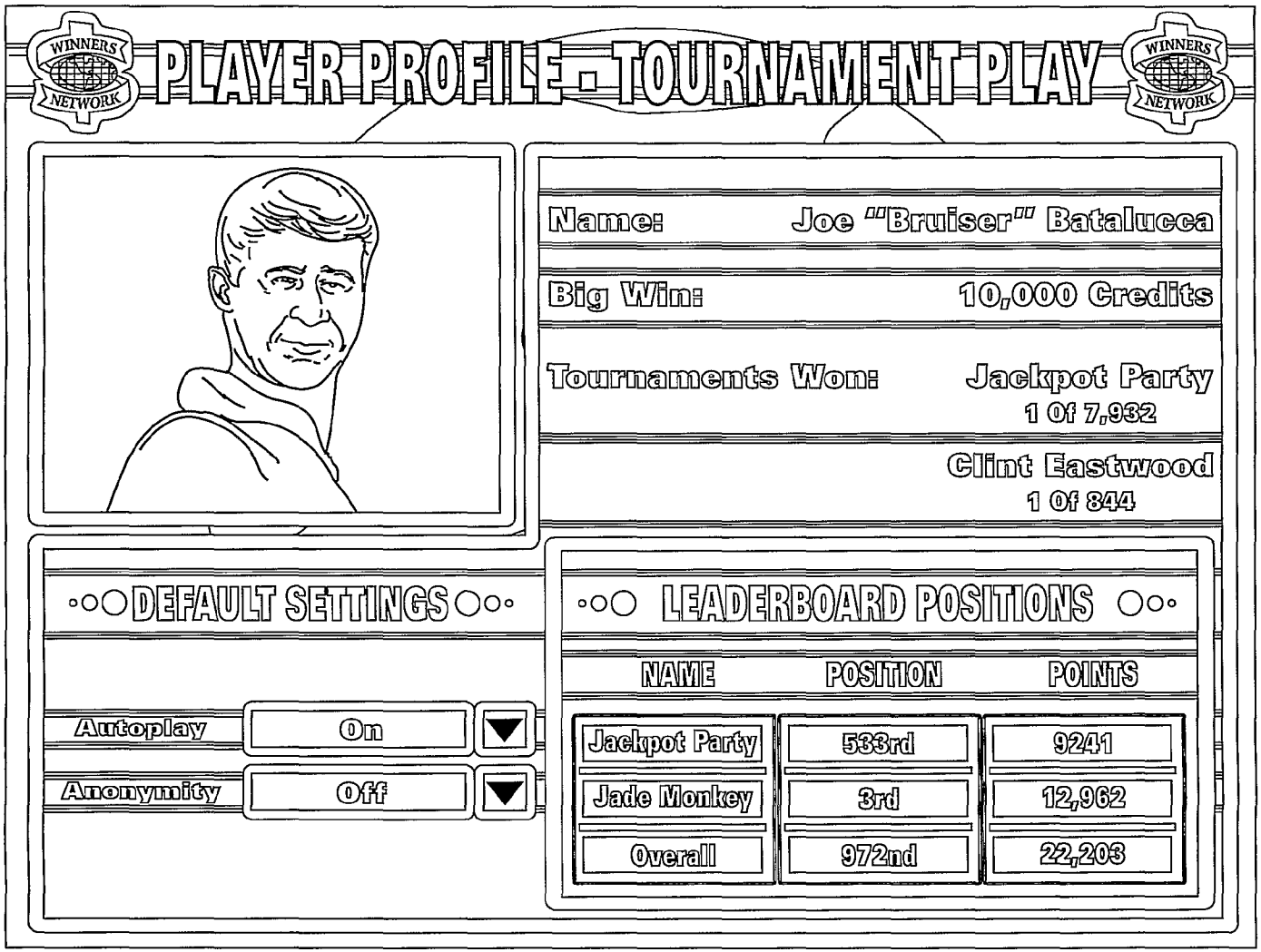
FIG. 10 is a representation of a player profile screen, according to an alternative embodiment of the present invention.

Referring to FIG. 10, a player profile menu can include player statistics such as the number of tournaments played, the number of tournaments won, the best results, the best game, the best tournament scores, the position on leaderboards, and the player's currently entered tournaments. For example, the menu indicates that the player's name is "Joe 'Bruiser' Batalucca," that the player's big win is "10,000 credits," and that the player has won two tournaments—the "Jackpot Party" tournament and the "Clint Eastwood" tournament. In the "Jackpot Party" tournament the player has ranked first out of 7,932 participants, and in the "Clint Eastwood" tournament the player has ranked first out of 844 participants. Other information in the player profile menu includes Autoplay and Anonymity settings and the player's leaderboard positions.

Figure 11:
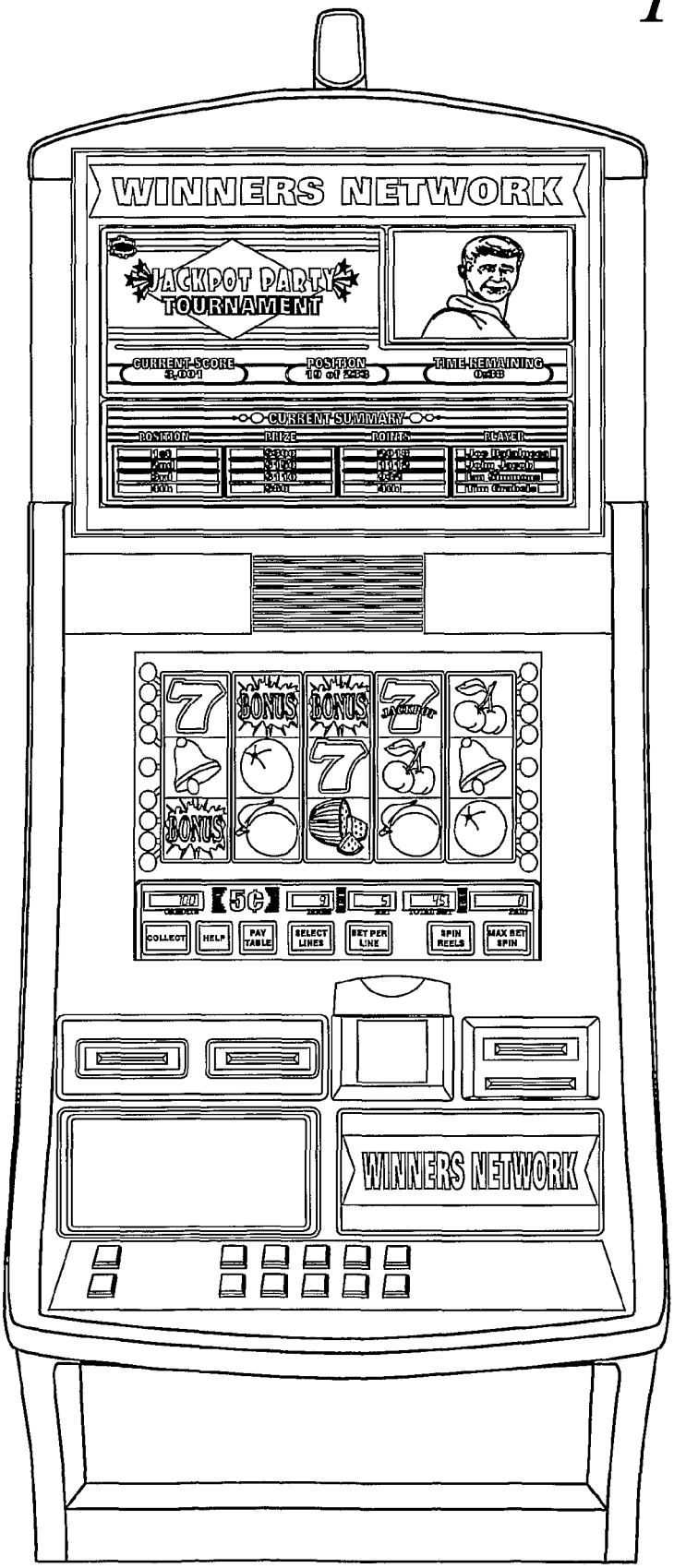
FIG. 11 is a representation of a gaming machine, according to an alternative embodiment of the present invention.
Figure 12:
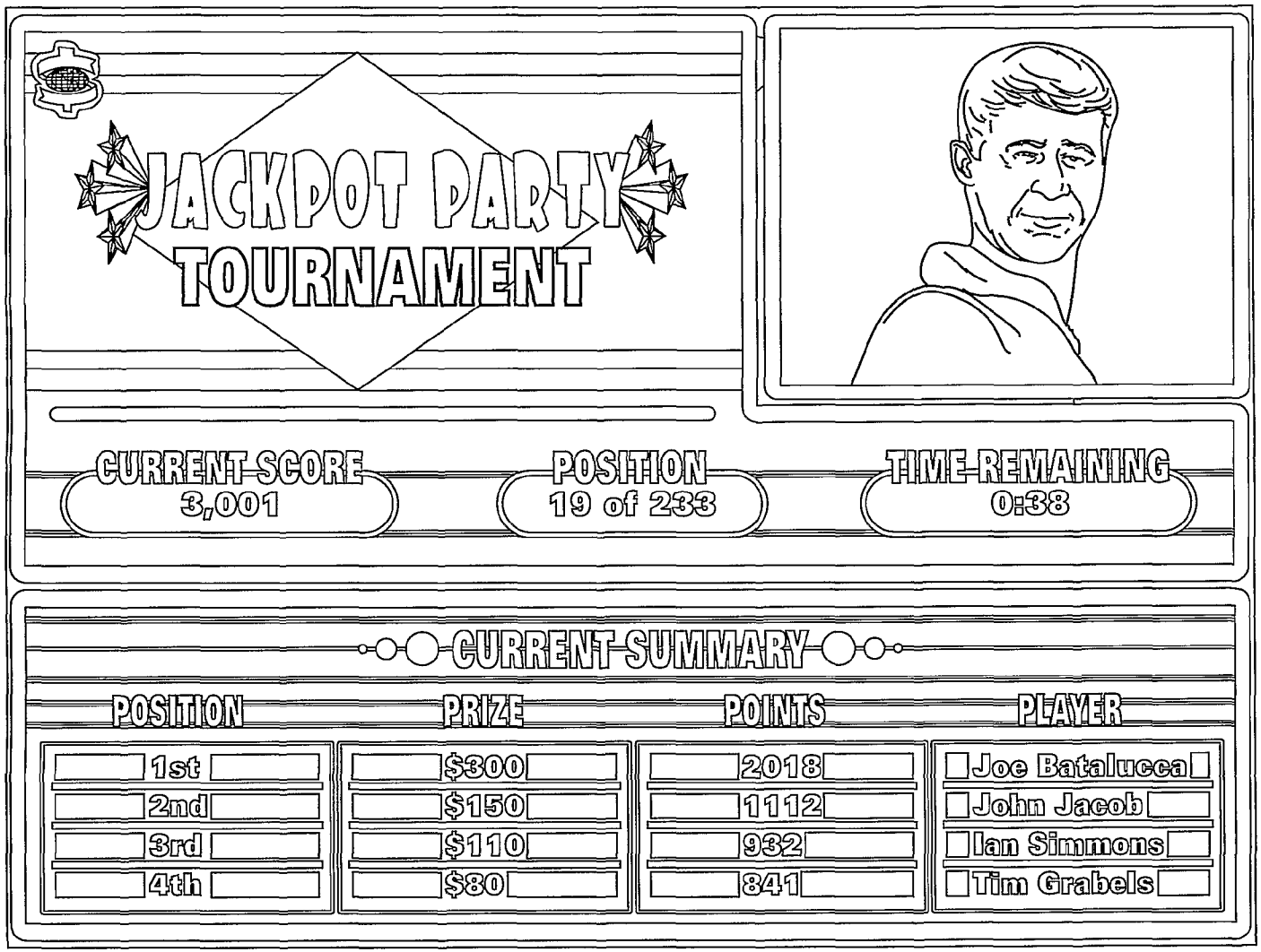
FIG. 12 is a representation of a player information screen, according to an alternative embodiment of the present invention.

Referring to FIGS. 11 and 12, gameplay information is presented to the player. The gameplay information indicates, for example, the time or number of hands remaining in the tournament, the number of credits accumulated, the player ranking in the tournament, and the name and score for the tournament leaders.

Figure 13:
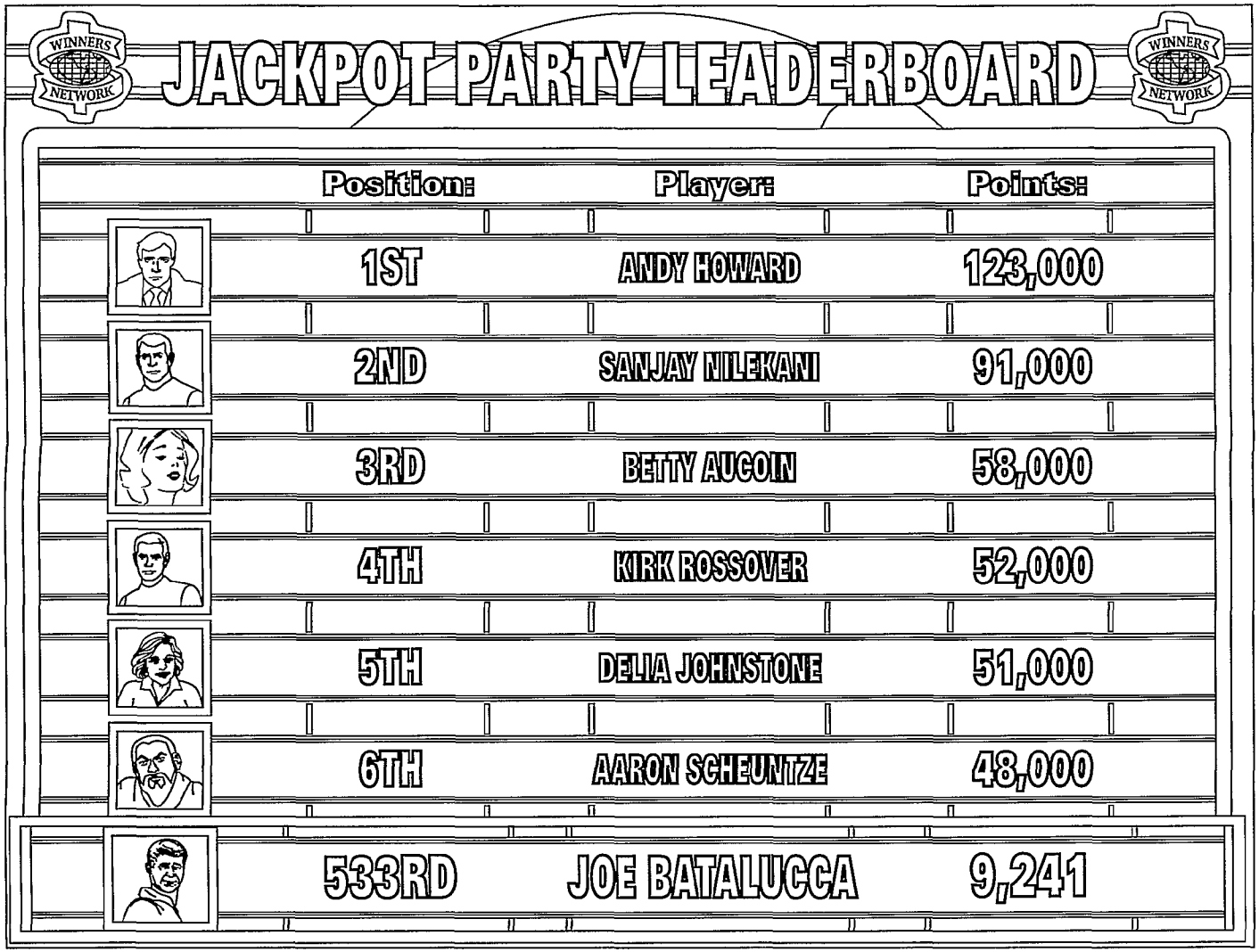
FIG. 13 is a representation of a leaderboard screen, according to an alternative embodiment of the present invention.

Referring to FIG. 13, a leaderboard indicates the rank and/or performance of a number of players. The leaderboards help in providing a community experience and a sense of loyalty with the Winners Network when playing Cash games or Tournament Mode games. The players' performance is ranked on several different aspects of slot achievement and displayed on the leaderboards.

Players earn Winners Network points based on a number of factors, which include how the players finish in relation to the size of the field (P), the player rank (R), the size of the field (N), and the cost of the tournament (C). Accordingly, a formula used for determining the awarded points is $$\text{POINTS}=8*\text{SQRT}(N/R)*(\text{LOG}(C+3)) \qquad \text{Equation 1}$$

The square root of "N/R" weighs the player performance against how well the player has ranked. The square root flattens the effect of the size of the field to ensure that a player that ranks first out of 100 participants is not ten times better than a player that ranks first out of 10 participants. The square root is particularly helpful in extremely large tournaments, wherein a person can gain a large point advantage over any other player. Thus, the square root is designed to flatten the volatility of the results and to keep the players in the same point range.

The logarithm of "C+3" weighs the players performance against the cost of the tournament. The logarithm flattens the effect of the cost to ensure that a $100 tournament is not ten times better than a $10 tournament, but only two times better. The "+3" ensures that the number is always greater than 1, even for a free tournament. At the conclusion of the tournament, all points are awarded to the players who have won money.

The player may participate in several different leaderboards, which include a "Championship Leaderboard" and a "Game Leaderboard." The "Championship Leaderboard" is a premiere leaderboard of the network that receives points from all the tournaments played on the network. The "Game Leaderboard" is an individual game leaderboard for tournaments played in a specific game, e.g., a "Jackpot Party" leaderboard.

A major motivation for having leaderboards is player prestige. In general, leaderboards encourage loyalty to the network and recognize players that have greater skill levels than other players. Leaderboards prizes can be offered for player achievement on the leaderboards. For example, prizes can be offered yearly, monthly, and/or weekly for winning or ranking high on the leaderboard. Prizes can also be offered for reaching a set number of points for a year (e.g., 1,000 points, 5,000 points, 10,000 points) or for reaching a lifetime point achievement (e.g., when a player reaches 1 million total points). Because the player himself cannot be verified, these prizes are promotional prizes that are not accounted in the estimated value ("EV") of the game.

Referring to FIG. 13, a "Jackpot Party Leaderboard" includes information related to a cash game, which is described in more detail below. The information includes the rank of the player, the player name, and the player's total points. The levels of achievement for cash games is different than for tournaments, and, accordingly, the achievement tracking for cash games is different than for tournaments. The "Jackpot Party Leaderboard" is a Game Records leaderboard, which can include a record bonus win (e.g., credits or multiple of bet), individual bonus achievement (e.g., record number of free spins, record number of retriggers, streaks (e.g., most winning spins in a row), highest base game prizes, top awards, etc.

Figure 14:
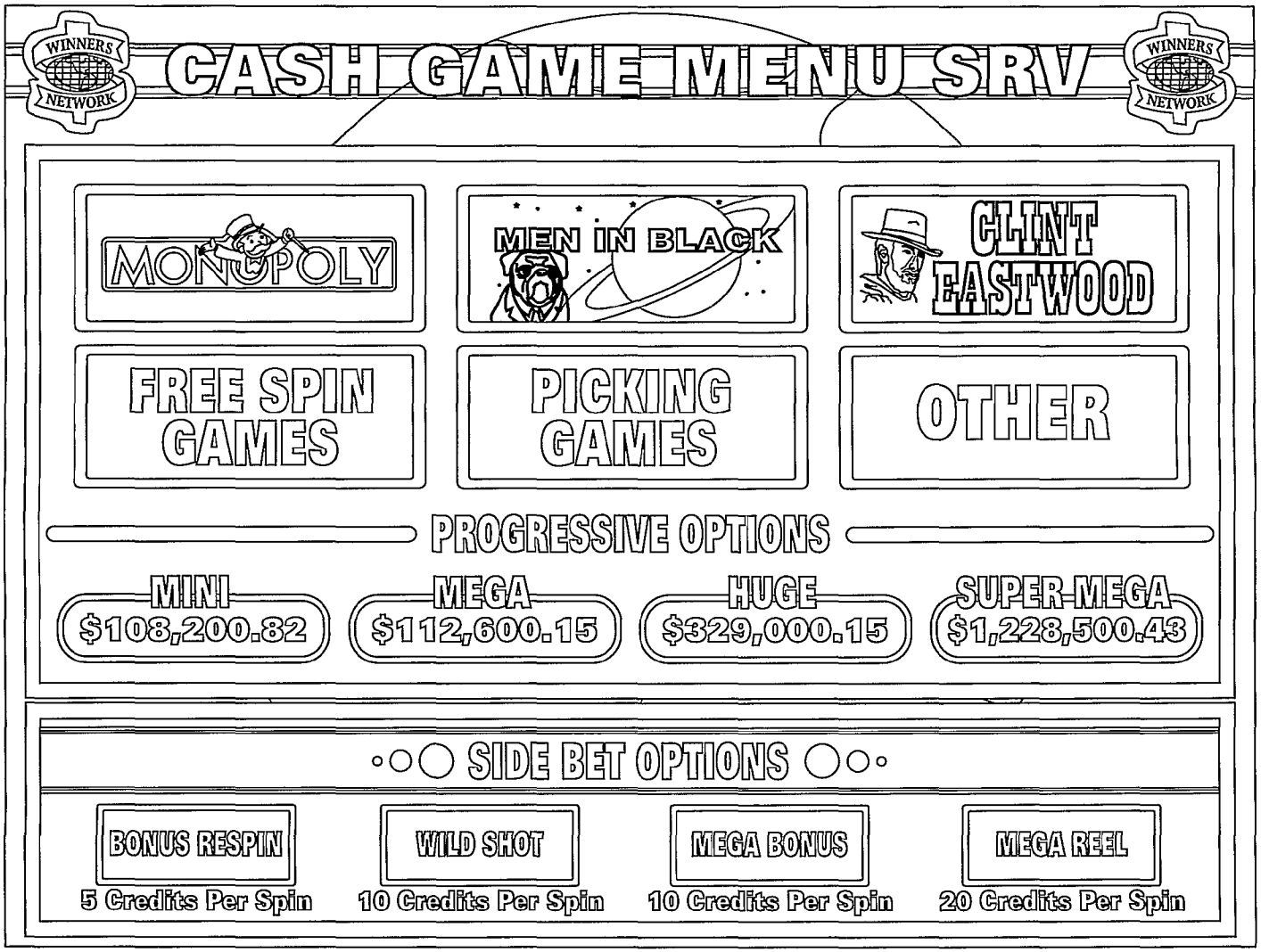
FIG. 14 is a representation of a cash game menu, according to an alternative embodiment of the present invention.

Referring to FIG. 14, a cash game menu includes several options for a player, including picking games, progressive options, and side bet options. Cash games are generally games that include normal standalone gameplay. In addition, cash games can be played in combination with a Wide Area Progressive ("WAP") game.

The Winners Network includes, optionally, several WAP games that are available to the players. One feature of the WAP games is that they are not associate with any games. A player can play any WAP with any game. One goal of the Winners Network is to provide additional bonuses without affecting gameplay. For example, the Winners Network provides an additional bonus by allowing the player to choose a progressive (i.e., "Choose a WAP").

Figure 15:
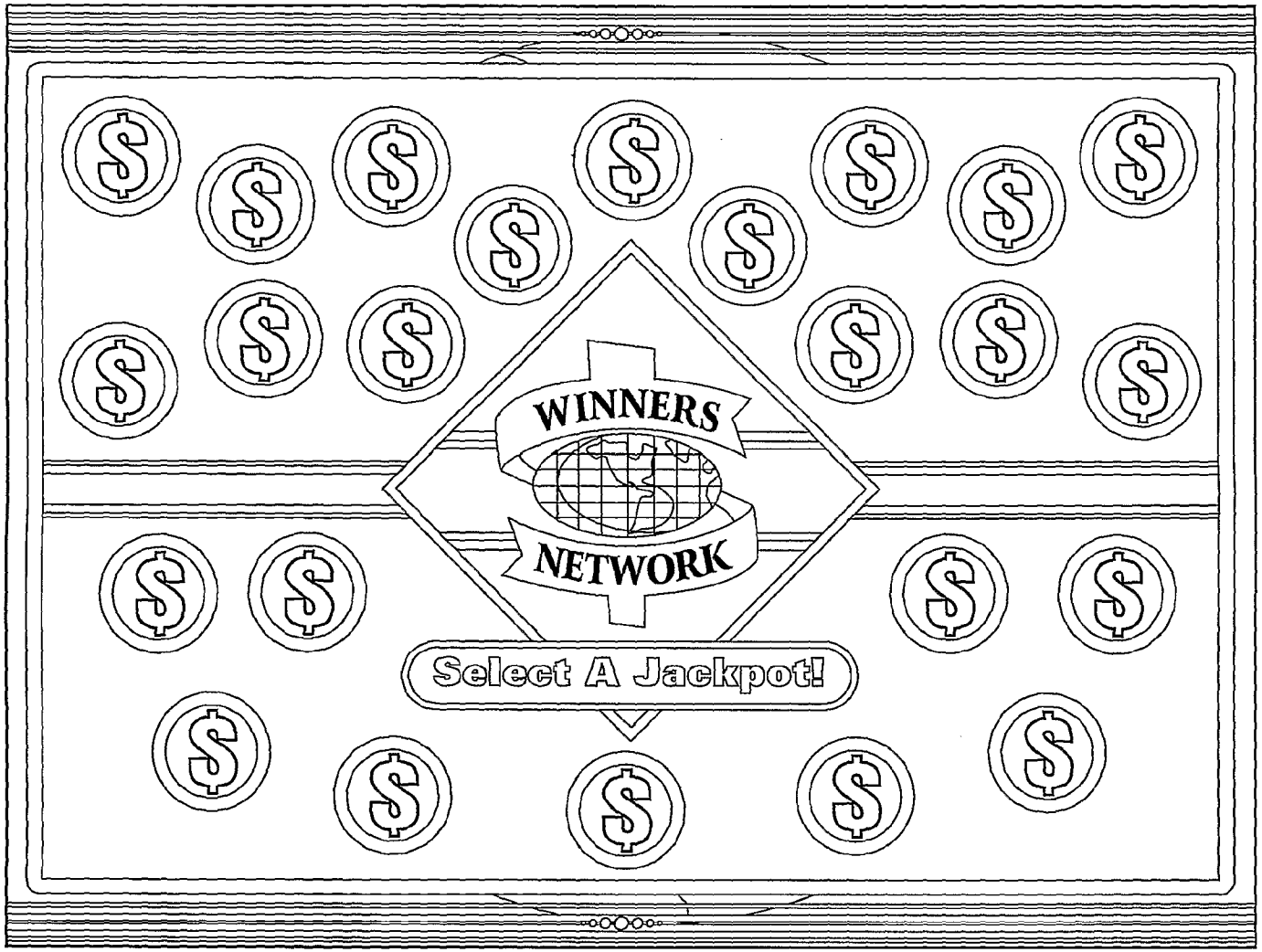
FIG. 15 is a representation of a wide area progressive screen, according to an alternative embodiment of the present invention.

Referring to FIG. 15, a Winners Network WAP selection screen includes a number of selections, including at least one WAP prize and large top awards. In the "Choose a WAP" method, the base game selected defaults to a lower WAP percentage. The first step to triggering the WAP is to obtain 5 progressive symbols on a first line of the game with any wager. When the player triggers the symbols, the player is taken to the Winners Network WAP screen. Depending on the odds of the particular game selected, as well as the odds of the particular WAP selected, the player is presented with the selection screen in which one item is the WAP and the other items are large top awards. To determine the number of successful WAP selections, an exemplary formula ca be used as follows:

$$X=(Y/\text{MAX BET})*(\text{GAME ODDS}/\text{WAP ODDS})*N \qquad \text{Equation 2}$$

In Equation 2, X is the number of correct selections, Y is the player's wager, MAX BET is the maximum wager allowed on the link, GAME ODDS is the individual game odds of getting the progressive, WAP ODDS is the odds of the selected WAP hitting, and N is the number of items in the Winners Network WAP selection screen. Thus, for example, it is assumed that a player is playing "Dirty Harry" on a Mega Link. The maximum wager on the link is $3 and the player has wagered $1. The odds of hitting the top award on "Dirty Harry" is 1 in 10 million, and the odds of hitting the Mega WAP is 1 in 50 million. The number of possible selections in the WAP screen is 30. Substituting the exemplary values in Equation 2, the following results are obtained:

$$X = (1/3)*(10m/50m)*30$$

$$X = (1/15)*30$$

$$X = 2$$

Thus, 2 of the 30 items on the selection screen will be the Mega WAP. The other 28 will be the top award prize.

Another goal of the Winners Network is to deliver the maximum amount of side wager features independent of the games. Side wagering has become a desired element in driving turnover in gaming devices. One reason for the increased popularity of side wagering is that players have embraced spending more credits per spin to get additional features and bonuses. Two types of side wagers are game independent side wagers and game dependent side wagers.

Game independent side wagers do not require interaction with the base game. Instead, the game independent side wagers use random numbers that are generated separate from the reels. The random numbers can provide, for example, a Random Bonus, a Random Prize, a Second Screen Bonus, and a Mega Bonus.

To receive a Random Bonus, for example, the player can place an additional wager of 5 credits per game to get a random variable multiplier applied to a win at the conclusion of the game. In another example, the player can place an additional 5 credits wager per spin to get a Random Prize of between 5 and 1,000 credits multiplied by the player's payline wager. In a further example, the player can place a 10 credit side wager per game on a "Jackpot Party" side wager option to randomly trigger a "Jackpot Party" bonus. Thus, at the conclusion of a slots spin the player can randomly trigger a selection of a Second Screen Bonus, e.g., the "Jackpot Party" bonus. Because these features are mystery features, the bonuses can be independent of the reel weightings. Accordingly, the bonus side wagers can be applied to all games.

A subset of the Second Screen Bonus is a Mega Bonus, which uses a full library of bonuses available in the gaming system. When the player makes the side wager, the player can randomly trigger any bonus in the gaming system library. An example of a calculation for a Mega Bonus is described below.

It is assumed that the player can wager 10 credits per spin with a maximum of 30 paylines, and that the Mega Bonus occurs once in 80 spins. When the Mega Bonus occurs, a selection is made from Table 1, which is listed below:

TABLE 1

| Game | Weighting | Return of Bonus | Total EV |
|---|---|---|---|
| Jackpot Party | 5/20 | 28 × bet | 7.0 |
| Jade Monkey | 2/20 | 40 × bet | 4.0 |
| Reel Em' In | 5/20 | 20 × bet | 5.0 |
| Pay Dirt | 4/20 | 25 × bet | 5.0 |
| Blue Lagoon | 3/20 | 30 × bet | 4.5 |
| Shakin' Bacon | 1/20 | 50 × bet | 10.0 |
| Total | 1 | N/A | 35.5 |

Assuming a 20 payline game, the total return would be 710 credits after the player has invested a total of 800 credits on average (80×10), for a total return of 88.75%. In addition, the Mega Bonus can be divided into different subgroups, e.g., classics, brands, free spin games, etc.

Game dependent side wagers generally have some type of relevance to the reel spin of the game. One example of a game dependent side wager is a Mega Reel Feature, which is related to the layout of the reels. For example, a Mega Reel Bonus is awarded randomly when 1 wild reel has a random spin based on an additional 10 credit wager per spin.

Another example of a game dependent side wager is a Weighted Table Method. The following examples show two different games (Table 2 and Table 3) having different settings.

TABLE 2

| Mega Reel - Game 1 | | | |
|---|---|---|---|
| Reel Wild | Chance % | EV of Wild Reel | Total EV |
| 1 | 0.2 | 12 × Bet | 2.4 |
| 2 | 0.2 | 15 × Bet | 3.0 |
| 3 | 0.2 | 8 × Bet | 1.6 |
| 4 | 0.2 | 6 × Bet | 1.2 |
| 5 | 0.2 | 2 × Bet | 0.4 |
| Total | 1 | | 7.6 |

TABLE 3

| Mega Reel - Game 2 | | | |
|---|---|---|---|
| Reel Wild | Chance % | EV of Wild Reel | Total EV |
| 1 | 0.2 | 20 × Bet | 4.0 |
| 2 | 0.2 | 16 × Bet | 3.2 |

TABLE 3-continued

| Mega Reel - Game 2 | | | |
|---|---|---|---|
| Reel Wild | Chance % | EV of Wild Reel | Total EV |
| 3 | 0.2 | 10 × Bet | 2.0 |
| 4 | 0.2 | 8 × Bet | 1.6 |
| 5 | 0.2 | 2 × Bet | 0.4 |
| Total | 1 | | 11.2 |

In Game 2 (shown in Table 3), the Wild Reel Feature provides considerably more value. If a total return of 90% is sought on this type of side wager, then the returns must be balanced on this game. This can be accomplished through the random chance of the feature hitting. For example, it is assumed that the game includes 20 paylines and the mega Reel wager is 10 credits per game. In Game 1, if the Wild Reel EV is 7.6 and the total credits won are 7.6×20=152, the feature requires a hit approximately once in 17 games to provide a 90% return. In Game 2, if the Wild Reel EV is 11.2 and the total credits won are 11.2×20=224, the feature requires a hit approximately once in 25 games to provide a 90% return. Optionally, the Wild Reel feature for each game can be imbedded in the math file of the game.

Figure 16:
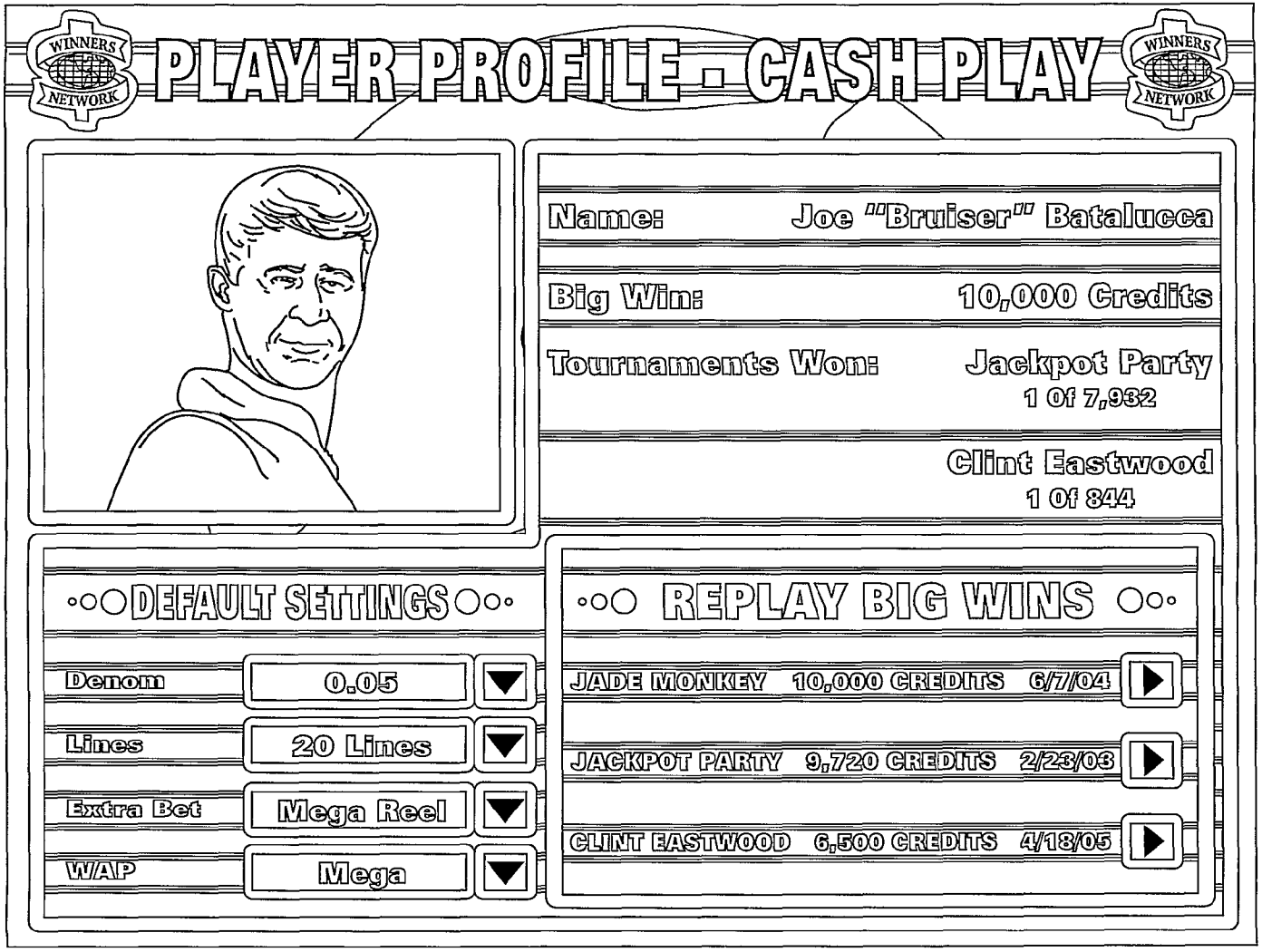
FIG. 16 is a representation of a cash game player profile screen, according to an alternative embodiment of the present invention.

Referring to FIG. 16, a player profile menu for cash play includes such features as records and default selections. For example, the records can include the player's big cash game and tournament wins. In addition, the player can replay their biggest wins to relive those great moments. The default settings screen allows the player to default to their cash game set up, which includes WAP games and Extra wagers.

Each of these embodiments and obvious variations thereof is contemplated as falling within the spirit and scope of the claimed invention, which is set forth in the following claims.

What is claimed is:

1. A method of operating a plurality of gaming machines of a gaming network, comprising:

receiving a wager, via an input device, from a player to play a wagering game on a gaming machine of the plurality of gaming machines;

initiating the wagering game on the gaming machine;

providing an option to the player, at the gaming machine, to choose to display leaderboard information on a display device of the gaming machine;

selectively displaying information from the leaderboard information;

ranking, by a controller, players on a leaderboard based on points awarded during at least one of a tournament and a cash game, wherein the points are calculated with a mathematical equation operating on at least the following factors: cost, number of participants in field, player rank, and player finish in relation to the number of participants;

wherein the mathematical equation includes a function for flattening an effect of at least one of the factors.

2. The method of claim 1, wherein the function flattens the effect of at least one of the cost and the number of participants in the field.

3. The method of claim 2, wherein the function flattens the effect of the cost by using a logarithm function of the cost.

4. The method of claim 1, wherein the mathematical equation includes a function for reducing a volatility of a number of points calculated with the mathematical equation.

5. The method of claim 4, wherein the function includes taking a square root function of the number of participants divided by the player rank.

6. The method of claim 1, wherein an effect of at least one of the factors is modified to result in a non-linear relationship between the calculated points and the at least one of the factors.

7. The method of claim 1, further including awarding a prize to the player for accumulating a certain number of the points.

8. The method of claim 1, further including awarding points to all players who have received an award.

9. A gaming machine, comprising:

a display for displaying a base game of the wagering game in response to receiving a wager input from a player; and a controller coupled to the display and programmed to initiate the base game on the gaming machine;

provide an option to the player, at the gaming machine, to choose to display on the display leaderboard information related to a tournament;

selectively display any of the leaderboard information related to the tournament;

award points to the player during at least one of a tournament and a cash game;

calculate the points with a mathematical equation operating on at least the following factors:

(i) cost, (ii) number of participants in field (iii) player rank, and (iv) player finish in relation to the number of participants; and determine a ranking of the player on a leaderboard based on the points;

wherein the mathematical equation includes a function for flattening an effect of at least one of the factors.

10. The gaming machine of claim 9, wherein the function flattens the effect of at least one of the cost and the number of participants in the field.

11. The gaming machine of claim 10, wherein the function flattens the effect of the cost by using a logarithm function of the cost.

12. The gaming machine of claim 9, wherein the mathematical equation includes a function for reducing a volatility of a number of points calculated with the mathematical equation.

13. The gaming machine of claim 12, wherein the function includes taking a square root function of the number of participants divided by the player rank.

14. The gaming machine of claim 9, wherein an effect of at least one of the factors is modified to result in a non-linear relationship between the calculated points and the at least one of the factors.

15. The gaming machine of claim 9, wherein the controller is further programmed to award a prize to the player for accumulating a certain number of points.

16. A method of operating a gaming network, comprising:

receiving a wager, via an input device, from a player to play a wagering game on a gaming machine of the gaming network;

allowing the player, at the gaming machine, to choose to display a leaderboard on a display device of the gaming machine;

selectively displaying information on the leaderboard;

awarding, by one or more controllers, points to the player based on play during at least one of a tournament and a cash game;

determining, by the one or more controllers, a ranking of the player on the leaderboard based on the points; and calculating, by the one or more controllers, the points with a mathematical equation operating on at least the following factors: cost, number of participants in filed, player rank, and player finish in relation to the number of participants, wherein the mathematical equation includes a function for flattening an effect of at least one of the factors.

17. The method of claim 16, wherein the function flattens the effect of the cost by using a logarithm function of the cost.

18. The method of claim 16, wherein the mathematical equation includes a function for reducing a volatility of a number of points calculated with the mathematical equation.

19. The method of claim 16, further including awarding a prize to the player for accumulating a certain number of the points.

20. A gaming network for conducting a wagering game, the gaming network comprising:

a plurality of gaming machines having respective displays for displaying the wagering game; and at least one controller coupled to the display and programmed to in response to receiving a wager input from a player on a gaming machine of the plurality of gaming machines, initiate the wagering game on the gaming machine;

allow the player to participate in a tournament;

provide an option to the player, at the gaming machine, to choose to display on the display leaderboard information related to the tournament;

selectively display leaderboard information related to the tournament;

determine ranking of the player on a leaderboard based on points received during the tournament; and calculate the points with a mathematical equation operating on four factors: cost, number of participants in field, player rank, and player finish in relation to the number of participants, wherein an effect of at least one of the four factors is modified to result in a non-linear relationship between the calculated points and the at least one of the four factors;

wherein the mathematical equation includes a function for flattening the effect of at least one of the four factors.

21. The gaming network of claim 20, wherein the function flattens the effect of at least one of the cost and the number of participants in the field.

22. The gaming network of claim 20, wherein the function flattens the effect of the cost by using a logarithm function of the cost.

23. A gaming network on which players play wagering games via a plurality of gaming machines, the gaming network comprising:

at least one input device allowing a player to place a wager to play one or more of the wagering games via a gaming machine of the plurality of gaming machines and allowing the player to choose to display a leaderboard on a display device of the gaming machine; and one or more controllers operable to award points to the player based on play during at least one of a tournament and a cash game;

determine a ranking of the player on the leaderboard based on the points; and calculate the points with a mathematical equation operating on at least the following factors: cost, number of participants in filed, player rank, and player finish in relation to the number of participants, wherein the mathematical equation includes a function for flattening an effect of at least one of the factors.

* * * * *